US012709502B2

(12) United States Patent
Morikawa et al.

(10) Patent No.: US 12,709,502 B2
(45) Date of Patent: Aug. 18, 2026

(54) MEDIA FEEDING APPARATUS

(71) Applicant: PFU LIMITED, Kahoku (JP)

(72) Inventors: Syuichi Morikawa, Kahoku (JP); Kiichiro Shimosaka, Kahoku (JP)

(73) Assignee: PFU LIMITED, Kahoku (JP)

( * ) Notice: Subject to any disclaimer, the term of this patent is extended or adjusted under 35 U.S.C. 154(b) by 0 days.

(21) Appl. No.: 18/666,205

(22) Filed: May 16, 2024

(65) Prior Publication Data

US 2024/0300756 A1 Sep. 12, 2024

Related U.S. Application Data

(63) Continuation of application No. PCT/JP2021/043697, filed on Nov. 29, 2021.

(51) Int. Cl.
*B65H 3/06* (2006.01)

(52) U.S. Cl.
CPC . *B65H 3/0638* (2013.01); *B65H 2404/13161* (2013.01); *B65H 2801/12* (2013.01)

(58) Field of Classification Search
CPC ..... B65H 3/0638; B65H 2404/13161
See application file for complete search history.

(56) References Cited

U.S. PATENT DOCUMENTS 10,138,081 B2 * 11/2018 Shimosaka ..... B65H 3/0638
10,836,595 B2 * 11/2020 Chiba ..... B65H 5/06
11,414,289 B2 * 8/2022 Kimura ..... B65H 3/56
2017/0097591 A1 * 4/2017 Shih ..... G03G 15/6511
2019/0225441 A1 7/2019 Chiba

FOREIGN PATENT DOCUMENTS

JP H08-53251 A 2/1996
JP H08-91614 A 4/1996
JP H08-310671 A 11/1996
JP H11-106067 A 4/1999

(Continued)

OTHER PUBLICATIONS

International Search Report dated Jan. 25, 2022 for corresponding PCT Application No. PCT/JP2021/043697 (3 pages) with English Translation (2 pages).

(Continued)

*Primary Examiner* — Patrick Cicchino
(74) *Attorney, Agent, or Firm* — Womble Bond Dickinson (US) LLP

(57) ABSTRACT

A media feeding apparatus includes: a feed roller, a separation roller, and a pressing portion to press one of the feed roller and the separation roller against the other to form a nip region. A surface of the feed roller has grooves extending in a width direction of the feed roller. The grooves are arranged with a pitch such that at least one groove is always present in the nip region during feeding of the medium. A width of each groove is 0.5 mm or greater and is set such that a contact area ratio is 0.5 or greater, the ratio being a value obtained by {(a surface area of the feed roller in the nip region−an area of the at least one groove of the feed roller in the nip region)}/(the surface area of the feed roller in the nip region). A surface of the separation roller has grooves extending in a circumferential direction of the separation roller.

4 Claims, 13 Drawing Sheets

(56) References Cited

FOREIGN PATENT DOCUMENTS

| | | | |
|---|---|---|---|
| JP | 2019-127363 | A | 8/2019 |
| JP | 2019-163146 | A | 9/2019 |
| JP | 2019-199352 | A | 11/2019 |

OTHER PUBLICATIONS

Written Opinion dated Jan. 25, 2022 for corresponding PCT Application No. PCT/JP2021/043697 (4 pages) with English Translation (4 pages).
International Preliminary Report on Patentability dated May 2, 2024 for corresponding PCT Application No. PCT/JP2021/043697 (5 pages) with English Translation (5 pages).

* cited by examiner

MEDIA FEEDING APPARATUS

CROSS-REFERENCE TO RELATED APPLICATION

This patent application is a continuation application of International Application No. PCT/JP2021/043697, having an international filing date of Nov. 29, 2021, the entire disclosure of which is hereby incorporated by reference herein.

BACKGROUND

The present disclosure relates to a media feeding apparatus.

A media feeding apparatus such as a scanner feeds media while separating the media one by one by a feed roller and a separation roller. In some cases, foreign matter such as paper dust, filler, coating agent (pigment), and powder is adhered to a medium. When such a medium is fed, there is a possibility that foreign matter adhered to the surface of the medium adheres to the feed roller, and the friction coefficient of the surface of the feed roller decreases, thus reducing the feeding performance. For this reason, in recent years, a feed roller having a groove capable of accommodating foreign matter has been developed.

For example, a paper feed roller is formed of a rubber composition and has a roller surface provided with irregularities.

For media feeding apparatuses, there is a demand for feeding media more favorably.

SUMMARY

According to an embodiment of the present disclosure, a media feeding apparatus includes a feed roller, a separation roller, and a pressing portion. The feed roller feeds a medium. The separation roller faces the feed roller. The pressing portion presses one of the feed roller and the separation roller against the other of the feed roller and the separation roller to form a nip region at a position where the feed roller and the separation roller contact each other. A surface of the feed roller has a plurality of grooves extending in a width direction of the feed roller. The plurality of grooves are arranged with a pitch such that at least one groove is always present in the nip region during feeding of the medium. A width of each of the plurality of grooves is 0.5 mm or greater and is set such that a contact area ratio is 0.5 or greater, the contact area ratio being a value obtained by {(a surface area of the feed roller in the nip region−an area of the at least one groove of the feed roller in the nip region)}/(the surface area of the feed roller in the nip region). A surface of the separation roller has a plurality of grooves extending in a circumferential direction of the separation roller.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
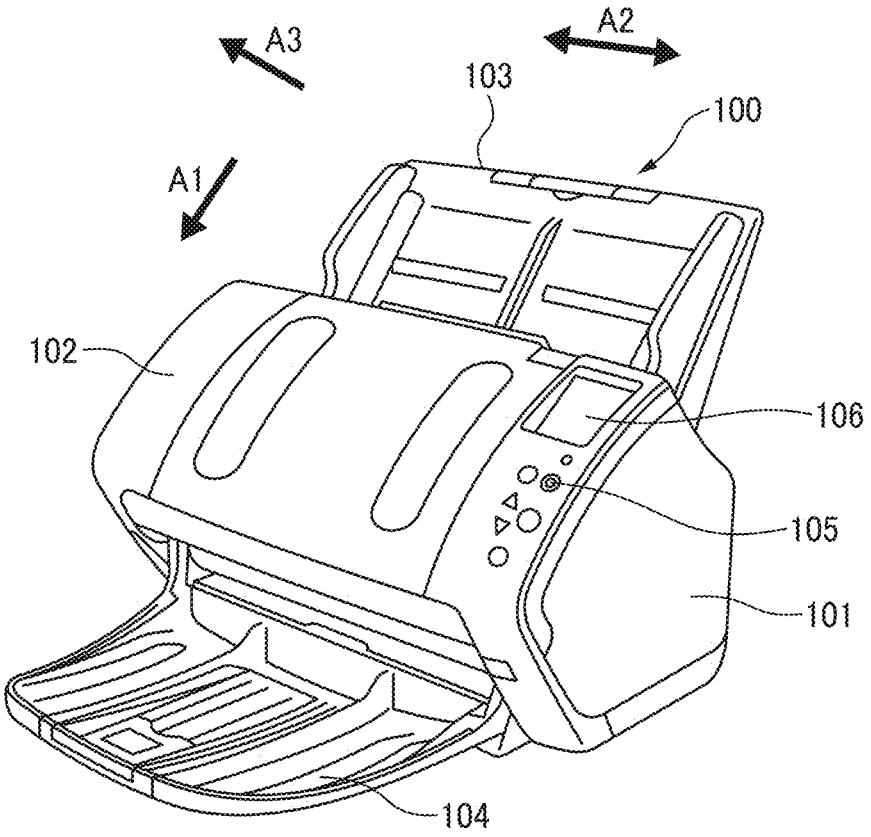
FIG. 1 is a perspective view of a media feeding apparatus according to an embodiment.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

A media feeding apparatus, a control method, and a control program according to an aspect of the present disclosure will be described below with reference to the drawings. The technical scope of the present disclosure, however, is not limited to the embodiments described below but includes the scope of the appended claims and the equivalents thereof.

FIG. 1 is a perspective view of a media feeding apparatus 100 configured as an image scanner. The media feeding apparatus 100 feeds and conveys a medium, which is an original document, and images the medium. Examples of the medium include, but not limited to, a paper sheet, a thin paper sheet, a thick paper sheet, a card, a booklet, and an envelope. Foreign matter such as paper powder, filler adhered at the time of production of a paper sheet, coating agent (pigment) adhered to coated paper, and powder adhered at the time of color printing are adhered to media to be fed. The media feeding apparatus 100 may be, for example, a facsimile machine, a copier, or a multifunction peripheral (MFP). The medium to be conveyed may be, for example, an object to be printed instead of an original document, and the media feeding apparatus 100 may be, for example, a printer.

The media feeding apparatus 100 includes, for example, a lower housing 101, an upper housing 102, a feed table 103, an ejection table 104, an operation device 105, and a display device 106. In FIG. 1, a media conveyance direction is indicated by arrow A1, a width direction perpendicular to the media conveyance direction is indicated by arrow A2, and a height direction perpendicular to the media conveyance direction A1 and the width direction A2 is indicated by arrow A3. In the following description, the term "upstream" refers to upstream in the media conveyance direction A1, and the term "downstream" refers to downstream in the media conveyance direction A1.

The upper housing 102 is disposed at a position at which the upper housing 102 covers the upper surface of the media feeding apparatus 100, and is rotatably engaged with the lower housing 101 with a hinge such that the upper housing 102 can be opened and closed to, for example, remove a jammed medium or clean the inside of the media feeding apparatus 100.

The feed table 103 is engaged with the lower housing 101, and media to be fed and conveyed are placed on the feed table 103. The ejection table 104 is engaged with the upper housing 102, and ejected media are placed on the ejection table 104. The ejection table 104 may be engaged with the lower housing 101.

The operation device 105 includes an input device such as keys and an interface circuit that acquires signals from the input device. The operation device 105 receives an input operation performed by a user and outputs an operation signal corresponding to the input operation performed by the user. The display device 106 includes a display and an interface circuit that outputs image data to the display and displays an image on the display according to the image data. Examples of the display include a liquid crystal display and an organic electro-luminescence (EL) display.

Figure 2:
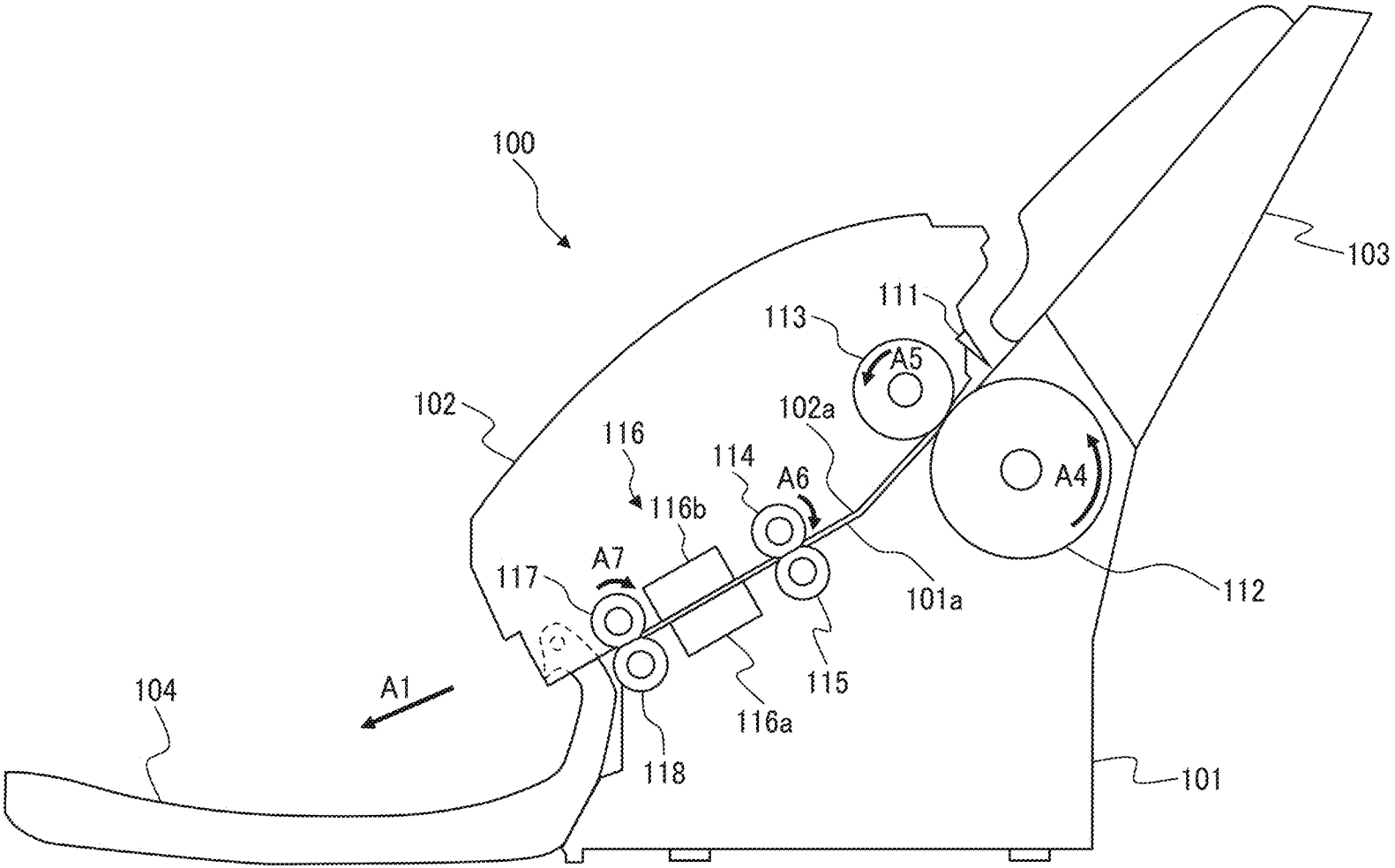
FIG. 2 is a diagram illustrating a conveyance path in the media feeding apparatus of FIG. 1.

FIG. 2 is a diagram illustrating a conveyance path in the media feeding apparatus 100.

The conveyance path in the media feeding apparatus 100 is provided with, for example, a media sensor 111, a feed roller 112, a separation roller 113, a first conveyance roller 114, a first counter roller 115, an imaging device 116, a second conveyance roller 117, and a second counter roller 118.

The number of each of the feed roller 112, the separating roller 113, the first conveyance roller 114, the first counter roller 115, the second conveyance roller 117, and/or the second counter roller 118 is not limited to one, and may be plural. In such a case, the feed rollers 112, the separation rollers 113, the first conveyance rollers 114, the first counter rollers 115, the second conveyance rollers 117, and/or the second counter rollers 118 are arranged in the width direction A2 perpendicular to the media conveyance direction A1 with a space(s) therebetween.

The upper face of the lower housing 101 forms a lower guide 101*a* of a media conveyance passage. The lower face of the upper housing 102 forms an upper guide 102*a* of the media conveyance passage.

The media sensor 111 is disposed upstream from the feed roller 112 and the separation roller 113. The media sensor 111 includes a contact detection sensor to detect whether a medium is placed on the feed table 103. The media sensor 111 generates a media signal of which the signal value changes depending on whether a medium is placed on the feed table 103 and outputs the generated media signal. The media sensor 111 is not limited to a contact detection sensor, and any other sensor such as an optical detection sensor that can detect the presence of a medium may be used as the media sensor 111.

The feed roller 112 is disposed in the lower housing 101 to separate and feed a medium in order from the lower side of the media placed on the feed table 103. The feed roller 112 is formed of, for example, resin such as rubber or plastic, or metal such as iron. The separation roller 113 is a so-called brake roller or retard roller. The separation roller is disposed in the upper housing 102 and faces the feed roller 112. The separation roller 113 is provided so as to be rotatable or stoppable in a direction opposite to a media feeding direction. The separation roller 113 is formed of, for example, a resin such as rubber or plastic, or a metal such as iron. The feed roller 112 may be disposed in the upper housing 102, the separation roller 113 may be provided in the lower housing 101, and the feed roller 112 may feed a medium in order from the upper side of the media placed on the feed table 103.

The first conveyance roller 114 and the first counter roller 115 are disposed downstream from the feed roller 112 and the separation roller 113 in the media conveyance direction A1. The first conveyance roller 114 is disposed in the upper housing 102 and conveys the medium fed by the feed roller 112 and the separation roller 113 to the imaging device 116. The first conveyance roller 114 is formed of, for example, a resin such as rubber or plastic, or a metal such as iron. The first counter roller 115 is disposed below the first conveyance roller 114 in the lower housing 101 and faces the first conveyance roller 114. The first counter roller 115 is rotated by the rotation of the first conveyance roller 114. The first counter roller 115 is formed of, for example, a resin such as rubber or plastic, or a metal such as iron. The first conveyance roller 114 may be disposed in the lower housing 101, and the first counter roller 115 may be disposed in the upper housing 102.

The imaging device 116 is an example of an imaging unit, is disposed downstream from the first conveyance roller 114 and the first counter roller 115 in the media conveyance direction A1, and images the medium conveyed by the first conveyance roller 114 and the first counter roller 115. The imaging device 116 includes a first imaging device 116*a* and a second imaging device 116*b* that faces each other with the medium conveyance path interposed therebetween.

The first imaging device 116*a* includes a contact image sensor (CIS) line sensor. The CIS line sensor employs an equal-magnification optical system and includes complementary metal oxide semiconductor (CMOS) imaging elements aligned linearly in the main scanning direction. The first imaging device 116*a* further includes a lens and an analog-to-digital (A/D) converter. The lens forms an image on the imaging elements. The A/D converter amplifies the electrical signals output from the imaging elements and performs analog-to-digital (A/D) conversion. The first imaging device 116*a* images the front side of the conveyed medium under the control of processing circuitry described below to generate and output an input image.

Likewise, the second imaging device 116*b* includes a CIS line sensor. The CIS line sensor employs an equal-magnification optical system and includes CMOS imaging elements aligned linearly in the main-scanning direction. The second imaging device 116*b* includes a lens that forms an image on the imaging device and an A/D converter that amplifies an electrical signal output from the imaging device and conducts A/D conversion. The second imaging device

116*b* captures the back side of the conveyed medium under the control of the processing circuitry described below to generate and output an input image.

The media feeding apparatus 100 may be configured to include only one of the first imaging device 116*a* and the second imaging device 116*b* and read only one side of the medium. The line sensor may be, instead of the CIS employing the equal-magnification optical system and including CMOSs as imaging elements, a CIS employing the equal-magnification optical system and including charge-coupled devices (CCDs) as imaging elements. Alternatively, a line sensor employing a reduction optical system and including a CMOS or CCD imaging element may be used.

The second conveyance roller 117 and the second counter roller 118 are disposed downstream from the imaging device 116, that is, downstream from the feed roller 112 and the separation roller 113 in the media conveyance direction A1. The second conveyance roller 117 is disposed in the upper housing 102, and conveys the medium conveyed by the first conveyance roller 114 and the first counter roller 115 to a further downstream region, and ejects the medium to the ejection table 104. The second conveyance roller 117 is formed of, for example, a resin such as rubber or plastic, or a metal such as iron. The second counter roller 118 is disposed below the second conveyance roller 117 in the lower housing 101 and faces the second conveyance roller 117. The second counter roller 118 is rotated by the rotation of the second conveyance roller 117. The second counter roller 118 is formed of, for example, a resin such as rubber or plastic, or a metal such as iron. The second conveyance roller 117 may be disposed in the lower housing 101, and the second counter roller 118 may be disposed in the upper housing 102.

The medium placed on the feed table 103 is conveyed in the media conveyance direction A1 between the lower guide 101*a* and the upper guide 102*a* by the rotation of the feed roller 112 in a direction indicated by arrow A4, that is, in the media feeding direction. The separation roller 113 rotates or stops in a direction indicated by arrow A5, that is, in the direction opposite to the media feeding direction. When a plurality of media is placed on the feed table 103, only the medium in contact with the feed roller 112 among the media placed on the feed table 103 is separated by action of the feed roller 112 and the separation roller 113. This prevents the feeding of a medium other than the separated medium. In other words, the multiple feeding is prevented.

The medium is fed between the first conveyance roller 114 and the first counter roller 115 while being guided by the lower guide 101*a* and the upper guide 102*a*. The medium is fed between the first imaging device 116*a* and the second imaging device 116*b* by the rotation of the first conveyance roller 114 in a direction indicated by arrow A6. The medium read by the imaging device 116 is ejected onto the ejection table 104 by the rotation of the second conveyance roller 117 in a direction indicated by arrow A7.

Figure 3:
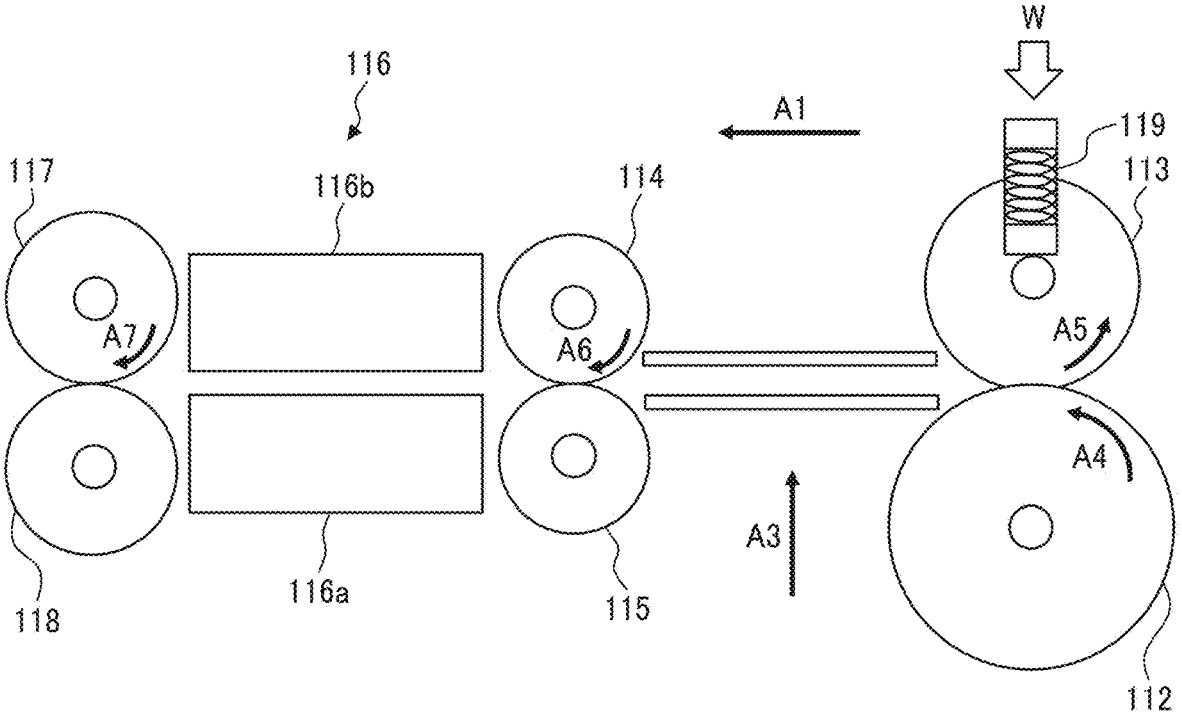
FIG. 3 is a schematic diagram illustrating forces applied to rollers.

FIG. 3 is a schematic diagram illustrating forces applied to the feed roller 112 and the separation roller 113.

As illustrated in FIG. 3, the media feeding apparatus 100 further includes a pressing member 119.

The pressing member 119 is an example of a pressing portion and is disposed at one end thereof on the upper housing 102 and at the other end thereof on a shaft which is a rotation axis of the separation roller 113, and presses the separation roller 113 toward the feed roller 112. The pressing member 119 includes an elastic member such as a torsion coil spring, and generates a pressing force W to press the separation roller 113 toward the feed roller 112. A nip region is formed at a position where the feed roller 112 and the separation roller 113 contacts each other by the pressing member 119. The pressing member 119 may include another spring member such as a plate spring or a rubber member. The pressing member 119 may be disposed to press the feed roller 112 toward the separation roller 113. In this manner, the pressing member 119 presses one of the feed roller 112 and the separation roller 113 against the other of the feed roller 112 and the separation roller 113 such that the nip region is formed at a position where the feed roller 112 and the separation roller 113 contact each other.

Figure 4:
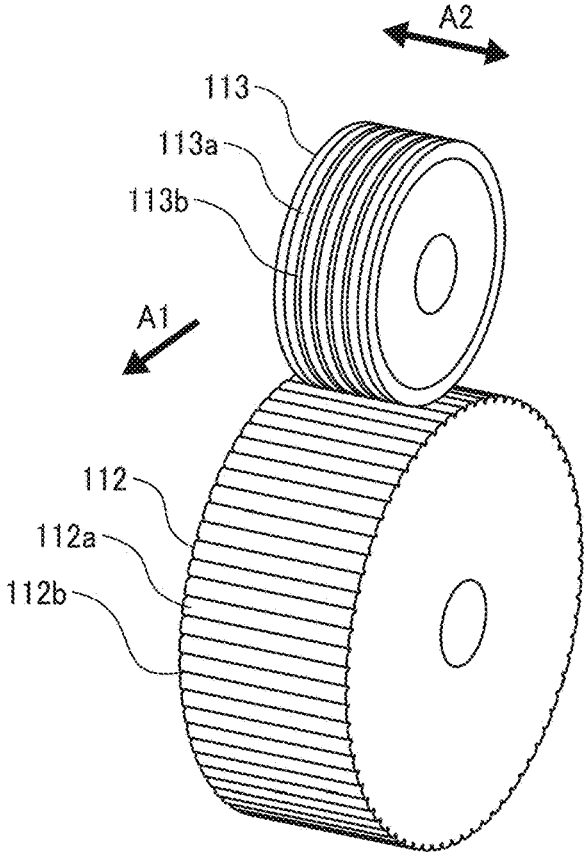
FIG. 4 is a schematic view of surfaces of rollers.

FIG. 4 is a schematic diagram illustrating the surfaces of the feed roller 112 and the separation roller 113. FIG. 4 is a perspective view of the feed roller 112 and the separation roller 113 as viewed from the downstream side.

As illustrated in FIG. 4, a plurality of grooves 112*b* are formed in a surface 112*a* of the feed roller 112, and the grooves 112*b* are arranged in the width direction A2 perpendicular to the media conveyance direction A1, that is, perpendicular to the media feeding direction (i.e., parallel to the shaft which is the rotation axis of the feed roller 112). That is, the plurality of grooves 112*b* are arranged at intervals from each other in the feeding direction of the medium so as to extend in the direction orthogonal to the feeding direction of the medium. The term "perpendicular to the feeding direction of the medium" is not limited to the case where the angle formed with the feeding direction of the medium is 90°, but also includes the case where the angle formed with the feeding direction of the medium is inclined by a predetermined angle (e.g., an angle within a range of +5°) with respect to 90°. Since the grooves 112*b* are arranged perpendicular to the feeding direction of the medium on the surface 112*a* of the feed roller 112, the feed roller 112 can more efficiently peel off (scrape off) the foreign matter attached to the medium, and can more efficiently accommodate the foreign matter in the grooves 112*b*.

A plurality of grooves 113*b* are formed in a surface 113*a* of the separation roller 113, and the grooves 113*b* are arranged in the media conveyance direction A1, that is, parallel to the media feeding direction (i.e., perpendicular to the shaft which is the rotation axis of the separation roller 113). That is, the plurality of grooves 113*b* are arranged side by side at intervals in the direction orthogonal to the feeding direction of the medium so as to extend in the feeding direction of the medium. The term "parallel to the feeding direction of the medium" is not limited to the case where the angle formed with the feeding direction of the medium is 0°, but also includes the case where the angle formed with the feeding direction of the medium is inclined by a predetermined angle (e.g., an angle within a range of +5°) with respect to 0°. Since the grooves 113*b* are formed in the surface 113*a* of the separation roller 113, the force of pushing back the medium by the separation roller 113 increases, and thus the media feeding apparatus 100 can reduce the occurrence of multiple feeding of media. In particular, since the grooves 113*b* are arranged in parallel to the feeding direction of the medium on the surface 113*a* of the separation roller 113, the positions of the grooves 113*b* in the nip region N do not change when the separation roller 113 rotates, and the separation force is maintained constant. Accordingly, the media feeding apparatus 100 can reduce the occurrence of multiple feeding of media.

Further, the extending direction of the groove 112*b* of the feed roller 112 is different from the extending direction of the groove 113*b* of the separation roller 113. Such a configuration prevents the groove 112*b* and the groove 113*b* from interfering with each other, thus preventing the separation roller 113 from bouncing (vibrating). Accordingly, the media feeding apparatus 100 can reduce the occurrence of multiple feeding of media.

Further, the extending direction of the groove 112*b* of the feed roller 112 and the extending direction of the groove 113*b* of the separation roller 113 are orthogonal to each other. With such a configuration, the foreign matter that is frayed from a medium and extends in various directions is accommodated in any of the grooves with a high probability.

Figure 5A:
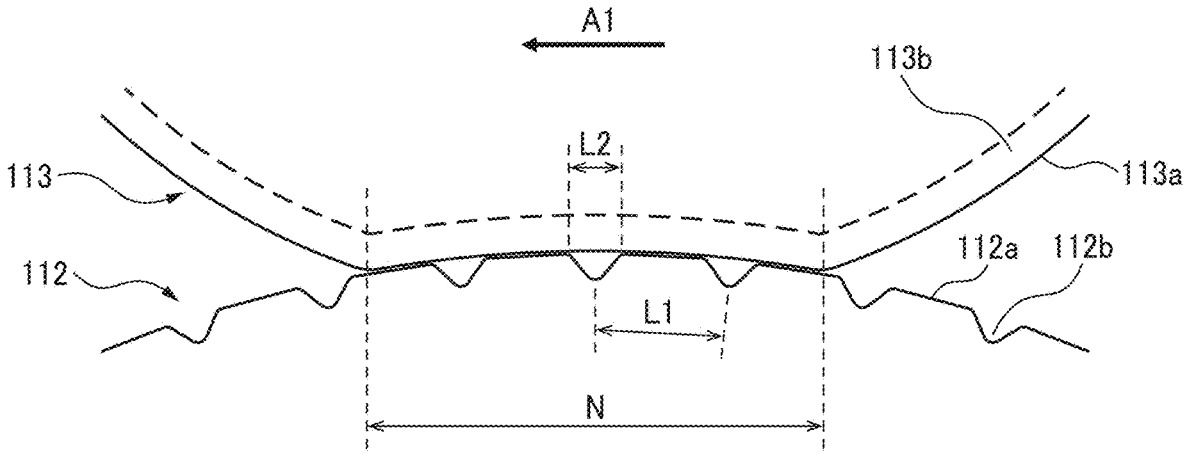
FIGS. 5A and 5B are schematic views of grooves of rollers.

FIG. 5A is a schematic diagram illustrating the grooves 112*b* of the feed roller 112. FIG. 5A is a schematic view of an area around the nip region between the feed roller 112 and the separation roller 113 as viewed from a lateral side.

As illustrated in FIG. 5A, the grooves 112*b* are formed at a constant pitch L1 along the circumferential direction on the surface 112*a* of the feed roller 112. The pitch L1 of the plurality of grooves 112*b* is set such that at least one groove 112*b* is always present in the nip region N during feeding of the medium. Each groove 112*b* of the feed roller 112 is set to have a width L2 of 0.5 mm or greater.

As a result of observing rollers returned after media started to slip in usage environments of users and rollers after media started to slip in acceleration tests, 90% or more of the mass of paper fibers adhered to rollers was 0.5 mm or less. In other words, the inventors have found that fibers contained in a medium such as a paper sheet are less likely to entirely come off the medium during feeding of the medium, and a part of the fibers are more likely to fray and float on the surface of the medium and rub against a roller and come off the medium. In the media feeding apparatus 100, the width L2 of the groove 112*b* of the feed roller 112 is set to be 0.5 mm or greater, and thus the fibers adhered to the surface 112*a* of the feed roller 112 can be efficiently accommodated in the grooves 112*b*. Accordingly, the media feeding apparatus 100 can prevent the adhesion of fibers to the surface 112*a* of the feed roller 112 from decreasing the friction coefficient between the surface 112*a* of the feed roller 112 and a medium, thus reducing the occurrence of the slip of the medium. Accordingly, the media feeding apparatus 100 can reduce the occurrence of jam of the medium.

Figure 5B:
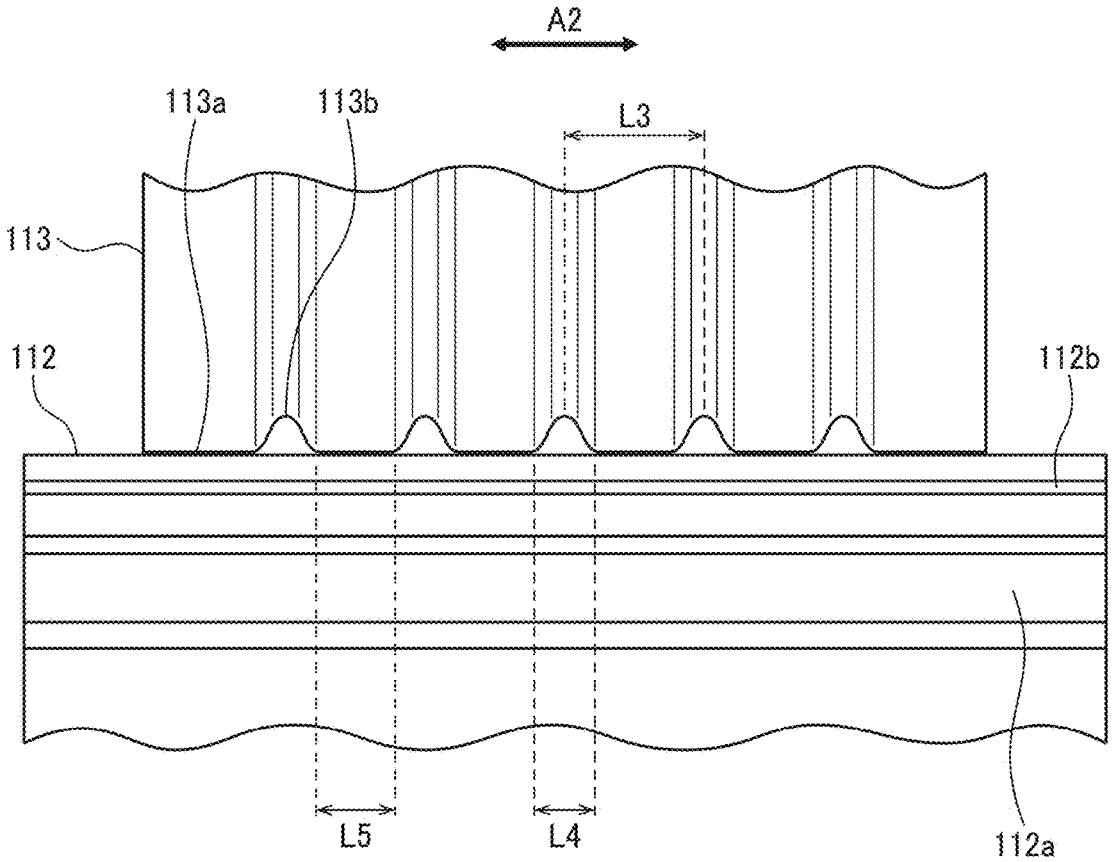

FIG. 5B is a schematic diagram illustrating the grooves 113*b* of the separation roller 113. FIG. 5A is a schematic view of an area around the nip region between the feed roller 112 and the separation roller 113 as viewed from the downstream side.

As illustrated in FIG. 5B, the plurality of grooves 113*b* are formed at a constant pitch L3 along the width direction A2 on the surface 113*a* of the separation roller 113. Each of the grooves 113*b* of the separation roller 113 is set to have a width L4 of 0.5 mm or greater.

As described above, when rollers in which a medium started to slip were observed, 90% or more of the mass of fibers of paper adhered to the rollers was 0.5 mm or less. In the media feeding apparatus 100, the width L4 of the groove 113*b* of the separation roller 113 is set to be 0.5 mm or greater, and thus the fibers adhered to the surface 113*a* of the separation roller 113 can be efficiently accommodated in the grooves 113*b*. Accordingly, the media feeding apparatus 100 can prevent the adhesion of fibers to the surface 113*a* of the separation roller 113 from decreasing the friction coefficient between the surface 113*a* of the separation roller 113 and a medium, thus reducing the occurrence of the slip of the medium. Accordingly, the media feeding apparatus 100 can reduce the occurrence of jam of the medium.

A contact area ratio S on the surface 112*a* of the feed roller 112 is set to be 0.5 or greater. The contact area ratio S of the feed roller 112 is calculated by the following Expression 1.

$$\text{Contact area ratio } S = \{(\text{surface area of surface } 112a \text{ of feed roller } 112 \text{ in nip region } N - \text{area of grooves } 112b \text{ of feed roller } 112 \text{ in nip region } N)\} / (\text{surface area of surface } 112a \text{ of feed roller } 112 \text{ in nip region } N) \quad (1)$$

Figure 6A:
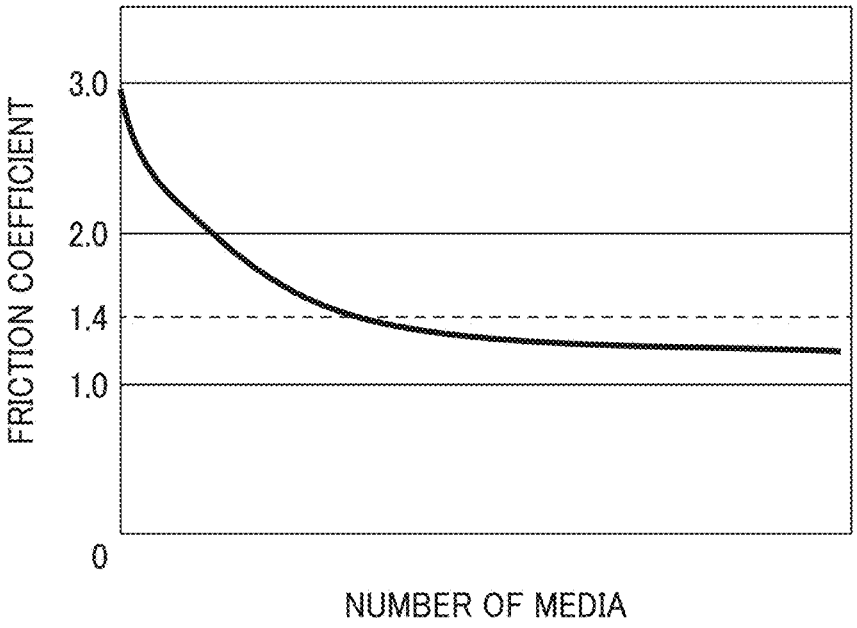
FIGS. 6A and 6B are graphs illustrating a contact area ratio.
Figure 6B:
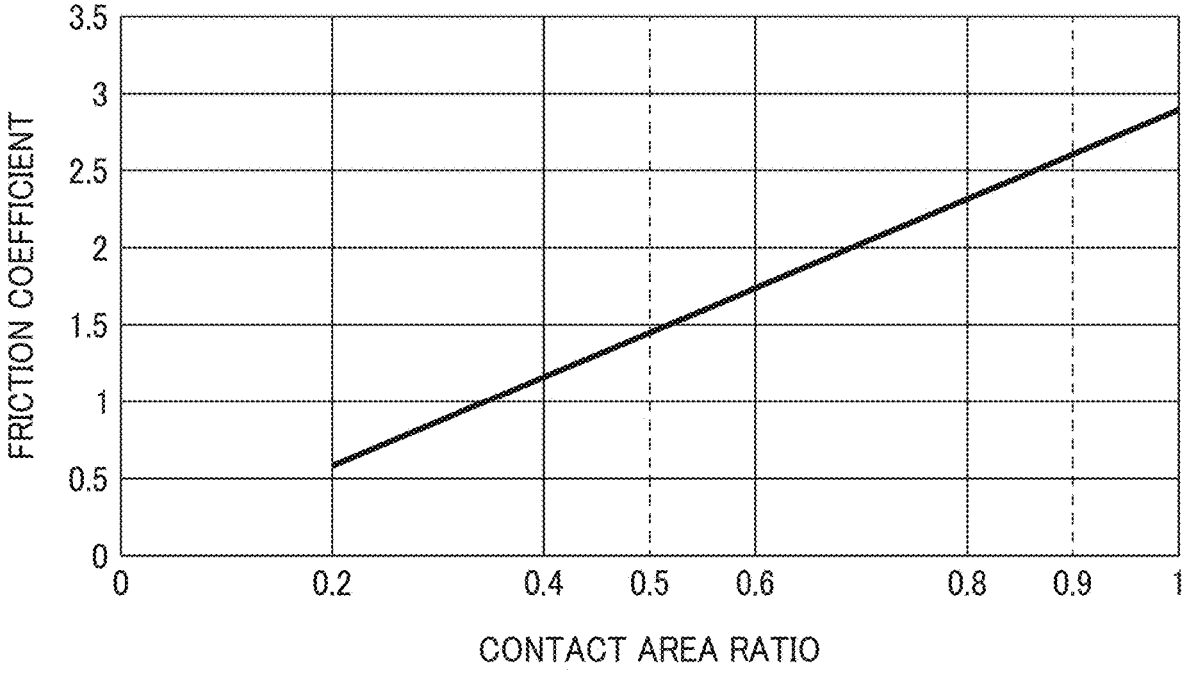
Figure 7:
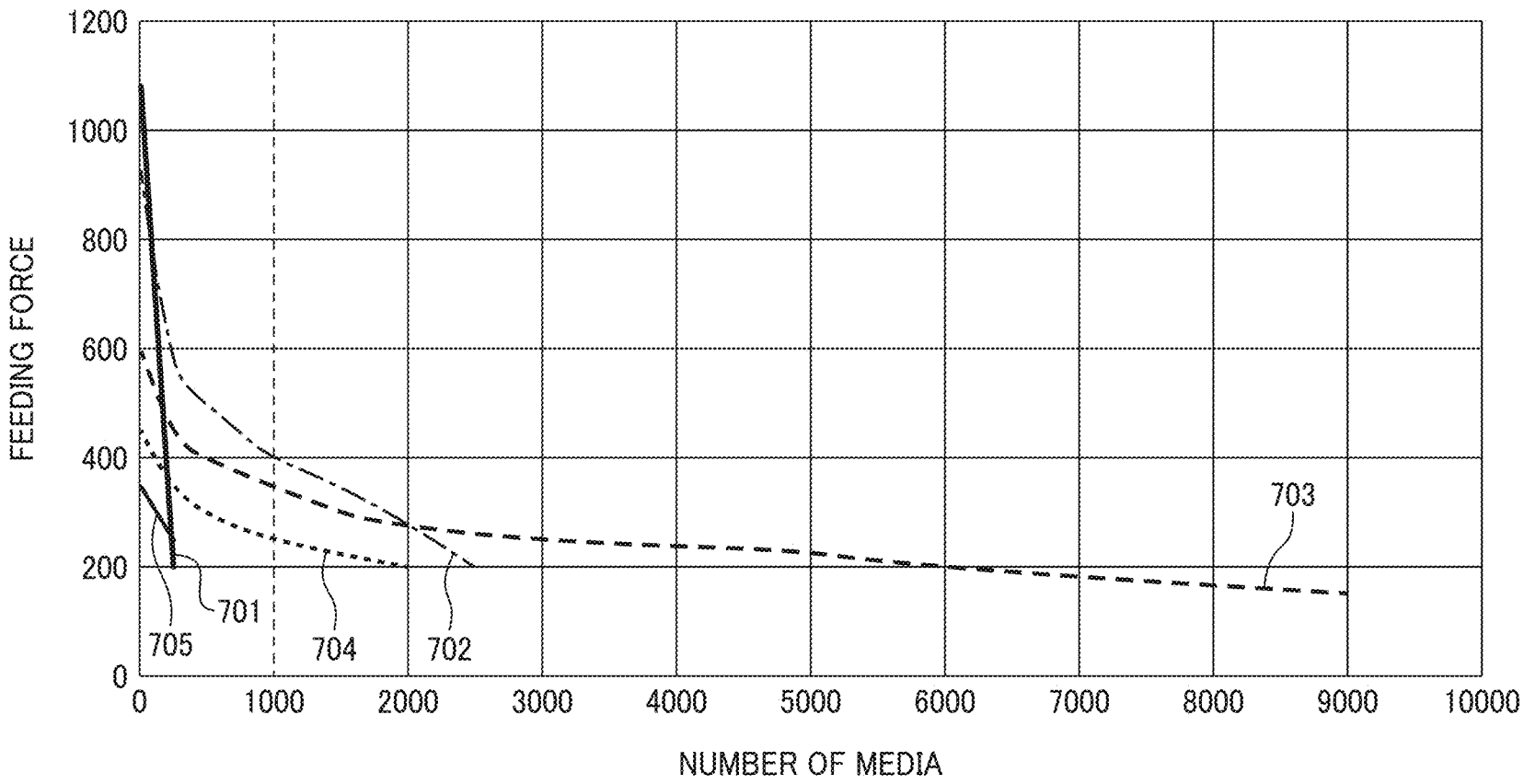
FIG. 7 is a graph illustrating the contact area ratio.

FIGS. 6A, 6B, and 7 are graphs illustrating the contact area ratio S of the feed roller 112.

FIG. 6A is a graph illustrating a relation between the number of media fed by the feed roller and the friction coefficient between the feed roller and the media. In FIG. 6A, the horizontal axis indicates the number of media fed by the feed roller, and the vertical axis indicates the friction coefficient between the feed roller and the media that have been fed by the number. The feed roller is a roller which has no groove and has a friction coefficient of about 3.0 with respect to the medium in an initial state (a state in which the medium has not been fed). As illustrated in FIG. 6A, as the number of fed media increases, the friction coefficient between the feed roller and the media decreases, and the possibility of the occurrence of the slip of the media increases. In particular, as a result of an acceleration test in which a large number of media to which foreign matter is attached is fed, the inventors have found that the frequency of occurrence of slip of media rapidly increases when the friction coefficient is less than 1.4.

The maximum static friction force between two objects is calculated by multiplying the shear strength (constant when the materials of the objects are the same) by the area where the two objects are actually in contact with each other. In other words, the frictional force between two objects is proportional to the contact area.

FIG. 6B is a graph illustrating a relation between the contact area ratio S of a feed roller having grooves and the friction coefficient between the feed roller and a medium. In FIG. 6B, the horizontal axis represents the contact area ratio S of the feed roller, and the vertical axis represents the friction coefficient between the feed roller and the medium. As illustrated in FIG. 6B, a proportional relation is established between the contact area ratio S and the friction coefficient. As described above, when the friction coefficient is less than 1.4, the frequency of occurrence of slip of media is high, and therefore, the friction coefficient is preferably 1.4 or greater. Since a proportional relation is established between the contact area ratio S and the friction coefficient, it is preferable that the contact area ratio S is equal to or greater than a value ($1.4/3.0 \approx 0.5$) obtained by dividing a threshold value (1.4) of the friction coefficient at which the frequency of occurrence of slip of media increases by an initial value (3.0). When the contact area ratio S of the feed roller 112 is set to 0.5 or greater, the media feeding apparatus 100 can reduce the frequency of occurrence of slip of media during feeding of the media.

FIG. 7 is a graph illustrating a relation between the number of media fed by the feed roller and the feeding force (feed force) of the media fed by the feed roller in the acceleration test in which a large number of media to which foreign matter is attached is fed. In FIG. 7, the horizontal axis indicates the number of media fed by the feed roller, and the vertical axis indicates the feeding force of the medium by the feed roller that has fed the number of media. The feeding force of the medium by the feed roller 112 is a force applied to the medium fed by the feed roller 112 in the media feeding direction, and is measured with a tension gauge attached to an upstream end of the medium fed by the feed roller 112.

A graph 701 illustrates a graph for a feed roller having a contact area ratio S of 0.35. A graph 702 illustrates a graph for a feed roller having a contact area ratio S of 0.50. A graph 703 illustrates a graph for a feed roller having a contact area ratio S of 0.60. A graph 704 illustrates a graph for a feed roller having a contact area ratio S of 0.90. A graph 705 illustrates a graph for a feed roller having a contact area ratio S of 0.95.

In order to properly feed a medium, a force of 200 gf or greater is needed as a feeding force. As illustrated in the graph 701, the feed roller having the contact area ratio S of 0.35 generates a sufficient feeding force in the initial state (state in which the medium has not been fed yet), and can feed the medium favorably. However, in this feed roller, the feeding force rapidly decreases every time a medium is fed, and when about 200 sheets of the medium are fed, the feeding force becomes less than 200 gf, and the medium cannot be appropriately fed. As illustrated in the graphs 702, 703, and 704, the feed roller having the contact area ratio S of 0.50, 0.60, or 0.80 was able to generate a sufficient feeding force and feed the medium favorably in the initial state and in the state in which 1000 or more sheets of media were fed. On the other hand, as illustrated in the graph 705, the feed roller having the contact area ratio S of 0.95 has failed to generate a sufficient feeding force in the initial state already, and has failed to appropriately feed the medium.

Accordingly, as described above, when the contact area ratio S is set to 0.5 or greater, the feed roller 112 can feed the medium favorably over a long period of time. The contact area ratio S is preferably set to be 0.9 or less. This allows the feed roller 112 to continue to feed a medium favorably for a long period of time from the initial state.

The contact area ratio S of the feed roller 112 is defined as the Expression 2 from Expression 1, and the pitch L1 of the grooves 112*b* of the feed roller 112 is defined as the Expression 3 from Expression 2.

$$\text{Contact area ratio } S = \{(\text{Pitch } L1 \text{ of grooves } 112b \text{ of feed roller } 112 - \text{width } L2 \text{ of groove } 112b \text{ of feed roller } 112)\}/(\text{pitch } L1 \text{ of grooves of feed roller } 112) \quad (2)$$

$$\text{Pitch } L1 \text{ of grooves } 112b \text{ of feed roller} = (\text{width } L2 \text{ of groove } 112b \text{ of feed roller } 112)/(1 - \text{contact area ratio } S) \quad (3)$$

Since the minimum value of the width L2 of the grooves 112*b* of the feed roller 112 is 0.5 mm and the minimum value of the contact area ratio S is 0.5, the minimum value of the pitch L1 of the grooves 112*b* of the feed roller 112 is 1.0 mm from Expression 3. In addition, the width of the nip region between the feed roller and the separation roller is typically set in a range of 4.0 mm to 6.0 mm. Since the pitch L1 of the grooves 112*b* of the feed roller 112 is set such that at least one groove 112*b* is always present in the nip region N during feeding of the medium, the maximum value of the pitch L1 is 4.0 mm. Therefore, the pitch L1 of the grooves 112*b* of the feed roller 112 is not less than 1.0 mm and not more than 4.0 mm.

The width L2 of the groove 112*b* of the feed roller 112 is defined as the Expression 4 from Expression 3.

$$\text{Width } L2 \text{ of groove } 112b \text{ of feed roller } 112 = (\text{pitch } L1 \text{ of grooves } 112b \text{ of feed roller } 112) \times (1 - \text{contact area ratio } S) \quad (4)$$

Since the maximum value of the pitch L1 of the grooves 112*b* of the feed roller 112 is 4.0 mm and the minimum value of the contact area ratio S is 0.5, the maximum value of the width L2 of the grooves 112*b* of the feed roller 112 is 2.0 mm from Expression 4. Therefore, the width L2 of the groove 112*b* of the feed roller 112 is 2.0 mm or less. The fiber length of 95% or more of the hardwood pulps used as paper sheets is 2.0 mm or less, and the fiber length of 50% or more of the softwood pulps used as paper sheets is 2.0 mm or less. Accordingly, when the width L2 of the groove 112*b* of the feed roller 112 is set to 2.0 mm, the media feeding apparatus 100 can accommodate most of the fibers of the hardwood pulps and the softwood pulps in the grooves 112*b* of the feed roller 112.

Thus, the feed roller 112 can continue to feed media favorably for a long period of time from the initial state while efficiently accommodating the foreign matter attached to the media to be fed in the grooves 112*b*.

Figure 8A:
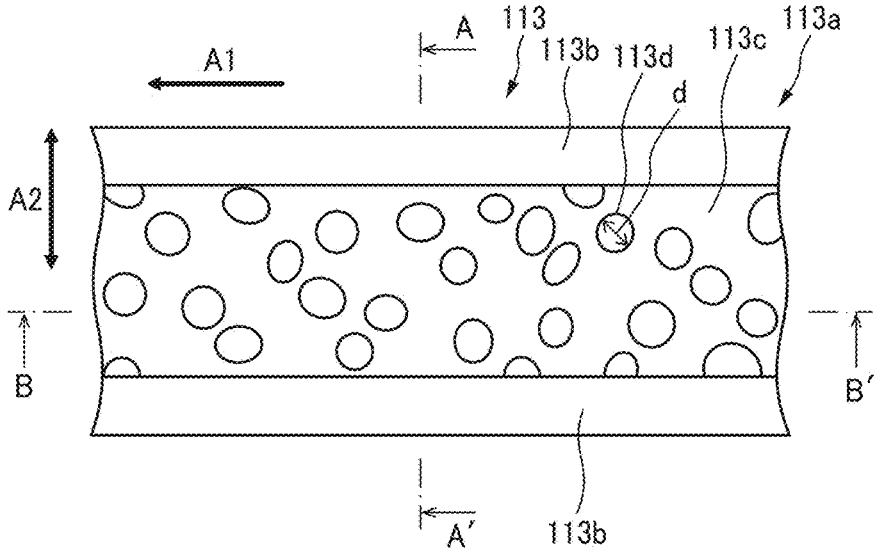
FIGS. 8A, 8B, and 8C are schematic views of a separation roller.
Figure 8B:
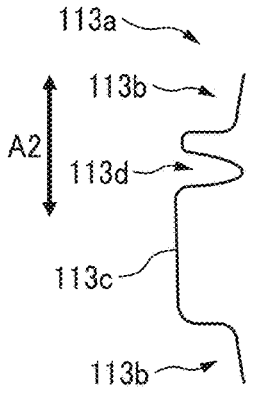
Figure 8C:
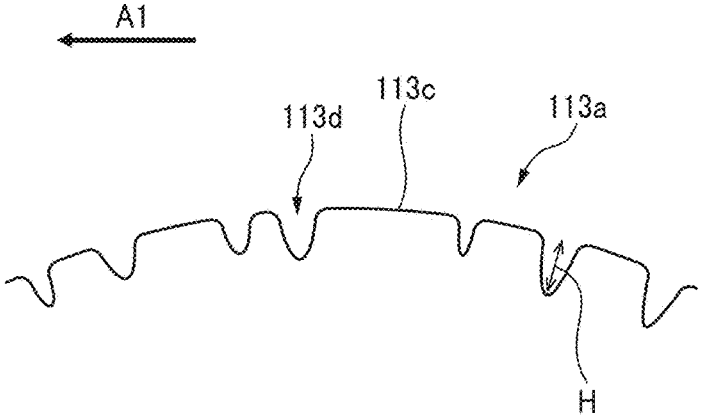

FIGS. 8A, 8B, and 8C are schematic diagrams illustrating the surface 113*a* of the separation roller 113. FIG. 8A is a schematic view of the surface 113*a* of the separation roller 113 as viewed from above. FIG. 8B is a cross-sectional view of the surface 113*a* of the separation roller 113 taken along a line A-A' of FIG. 8A, and FIG. 8C is a cross-sectional view of the surface 113*a* of the separation roller 113 taken along a line B-B' of FIG. 8A.

As illustrated in FIGS. 8A, 8B, and 8C, a plurality of flat portions 113*c* are formed on the surface 113*a* of the separation roller 113, and are arranged between the plurality of grooves 113*b*. Each of the flat portions 113*c* is formed with a plurality of opening portions 113*d*. Each of the opening portions 113*d* is formed by hollowing out a part of the flat portion 113*c* in a hemispherical shape (dome shape). In other words, each of the opening portions 113*d* is formed in a circular shape when viewed from above. Each of the opening portions 113*d* may be formed in any other shape such as an elliptical shape, a rectangular shape, or a triangular shape.

When a medium is fed, the surface 113*a* of the separation roller 113 vibrates due to the separation operation of the medium by the separation roller 113. Accordingly, an abnormal noise (so-called squeaking noise or slip-stick noise) occurs around the separation roller 113. The squeaking noise is a noise in a specific frequency band (of, e.g., 3 kHz to 4 kHz or 6.5 kHz to 8 kHz).

The frequency $f_{ss}$ of vibration of a vibration system on the surface 113*a* of the separation roller 113 is calculated by the following Expression 5, and the amplitude $A_{ss}$ of the vibrations is calculated by the following Expression 6.

$$f_{ss} = kv/\{2(\mu_s - \mu_k)W\} \quad (5)$$

$$= (\mu_s - \mu_k)W/k \quad (6)$$

Here, k is the rigidity (spring constant) of the surface 113*a* of the separation roller 113. The reference sign v represents a moving speed at which a medium moves with respect to the surface 113*a* of the separation roller 113. The reference sign us represents a coefficient of static friction between the surface 113*a* of the separation roller 113 and the medium. The reference sign uk represents a coefficient of kinetic friction between the surface 113*a* of the separation roller 113 and the medium. The reference sign W represents a vertical load applied to the surface 113*a* of the separation roller 113. For the calculation of the frequency $f_{ss}$ and the amplitude $A_{ss}$, refer to "Ken Nakano, Satoru Maekawa, Soft Materials and Frictional Vibration, one hundred seventy seventh Rubber Technology Symposium, Japan Rubber Association, p 1-10 (2012)".

From Expressions 5 and 6, the amplitude $A_{ss}$ of vibration is calculated by the following Expression 7.

$$A_{ss} = v/2f_{ss} \tag{7}$$

As illustrated in Expression 7, the amplitude $A_{ss}$ of the surface 113*a* of the separation roller 113 is proportional to the moving speed v of the medium with respect to the surface 113*a* of the separation roller 113.

Figure 9:
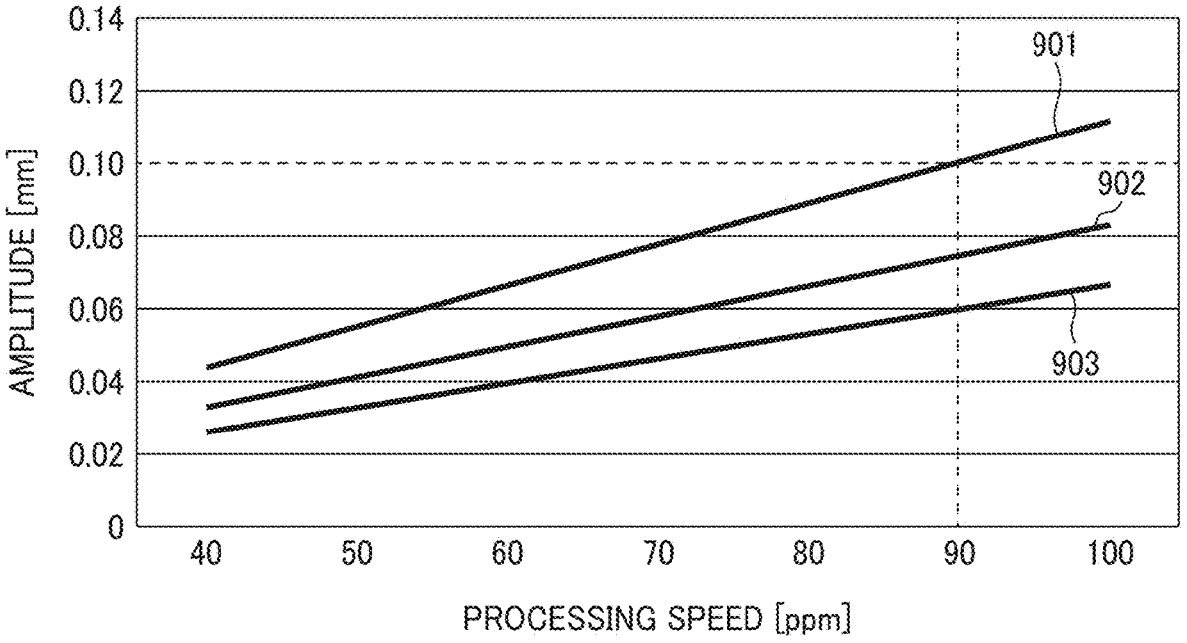
FIG. 9 is a graph illustrating a relation between the moving speed of a medium and amplitude.

FIG. 9 is a graph illustrating a relation between the moving speed (processing speed) of the medium with respect to the surface 113*a* of the separation roller 113 and the amplitude $A_{ss}$ of the surface 113*a* of the separation roller 113.

In FIG. 9, the horizontal axis represents the moving speed (processing speed) [ppm] of the medium with respect to the surface 113*a* of the separation roller 113, and the vertical axis represents the amplitude $A_{ss}$ [mm] in vibration of the surface 113*a* of the separation roller 113. A graph 901 illustrates the amplitude $A_{ss}$ in the case where the frequency $f_{ss}$ of vibration of the surface 113*a* of the separation roller 113 is 3 kHz. A graph 902 illustrates the amplitude $A_{ss}$ in the case where the frequency $f_{ss}$ is 4 kHz. Graph 903 illustrates the amplitude $A_{ss}$ in the case where when the frequency $f_{ss}$ is 5 kHz.

The moving speed (processing speed) of the medium in the media feeding apparatus is typically 90 ppm or less. Therefore, as illustrated in FIG. 9, when the frequency $f_{ss}$ of vibration of the surface 113*a* of the separation roller 113 is 3 kHz or greater and 5 kHz or less, the amplitude of the surface 113*a* of the separation roller 113 is 0.10 mm or less. In the media feeding apparatus 100, the diameter (maximum width) d of the plurality of opening portions 113*d* is set to 0.10 mm or greater, which can block (or reduce) the noise caused by the vibration of the surface 113*a* of the separation roller 113 from propagating on the surface 113*a*.

Typically, in order to separate the medium favorably, the width L5 (see FIG. 5B) of each of the plurality of flat portions 113*c* arranged between the plurality of grooves 113*b* in the surface 113*a* of the separation roller 113 is set to 1.0 mm or greater. On the other hand, if the diameter d of the opening portion 113*d* is too large, the medium is not separated well. An experiment was conducted in which media were fed by using a plurality of separation rollers having flat portions with a width of 1.0 mm and opening portions with different diameters. As a result, the media were favorably separated when the diameter of the opening portion was 0.35 mm or less, but the medium was not separated when the diameter of the opening portion was greater than 0.35 mm. Therefore, the diameter d of each of the opening portions 113*d* is preferably 0.35 mm or less.

Accordingly, the diameter d of each of the opening portions 113*d* is set to be 0.10 mm or greater and 0.35 mm or less. Thus, the media feeding apparatus 100 can reduce the occurrence of squeaking noise while separating a medium favorably.

It is preferable that the depth H of each of the opening portions 113*d* is 0.2 mm or greater such that the opening portions 113*d* are present even when the surface 113*a* of the separation roller 113 is worn.

Typically, the separation roller is formed as an annular elastic body around a shaft which is a rotation axis. The annular elastic body includes two layers: an outer layer formed of a non-foam layer and an inner layer formed of a foam layer. In such a separation roller, the thickness (depth) of the outer layer is typically set to be 1.0 mm or more and 1.5 mm or less. The depth H of each of the opening portions 113*d* is preferably 1.0 mm or less such that the opening portions 113*d* are formed in the outer layer of the separation roller 113.

Therefore, the depth H of each of the opening portions 113*d* is set to be 0.2 mm or greater and 1.0 mm or less. Thus, the media feeding apparatus 100 can continue to hold the opening portions 113*d*, even when the surface 113*a* is worn, with the opening portions 113*d* being formed only in the outer layer of the separation roller 113.

A contact area ratio P on the surface 113*a* of the separation roller 113 is set to be 0.4 or greater. The contact area ratio P of the separation roller 113 is calculated by the following Expression 8.

$$\text{Contact area ratio } P = \{(\text{surface area of surface } 113a \text{ of seperation roller } 113 \text{ in nip region } N - \text{area of groove } 113b \text{ of seperation roller } 113 \text{ in nip region } N - \text{total area of opening portion } 113d \text{ of seperation roller } 113 \text{ in nip region } N)\}/(\text{surface area of surface } 113a \text{ of seperation roller } 113 \text{ in nip region } N) \tag{8}$$

Figure 10A:
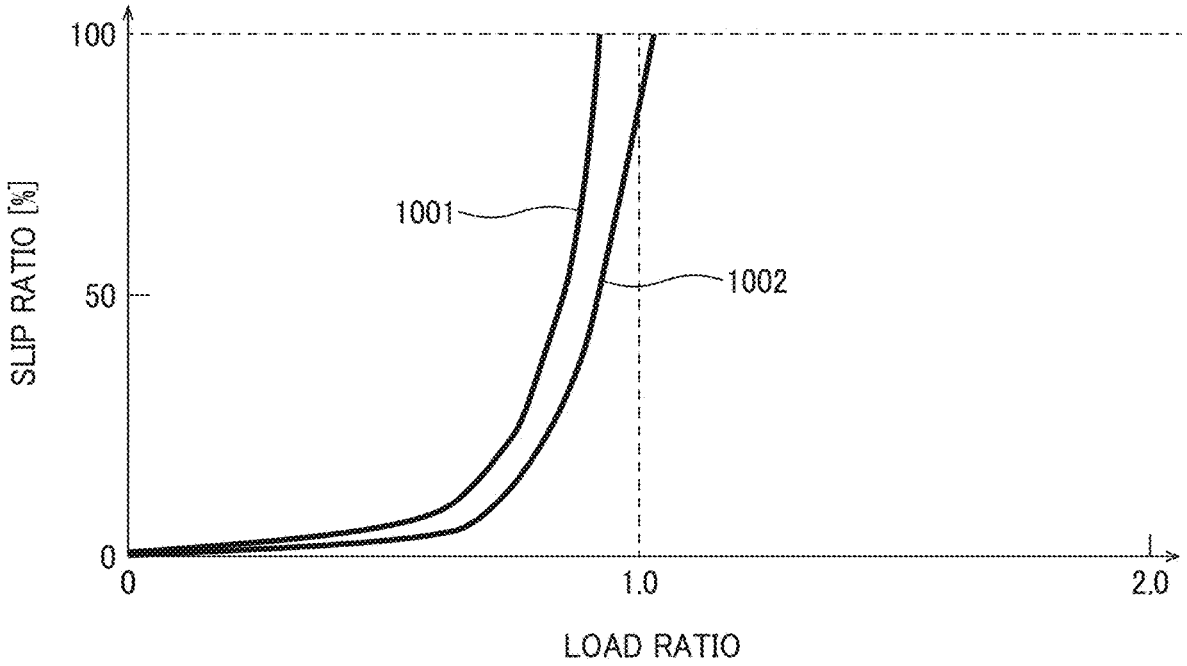
FIGS. 10A and 10B are graphs illustrating a contact area ratio.
Figure 10B:
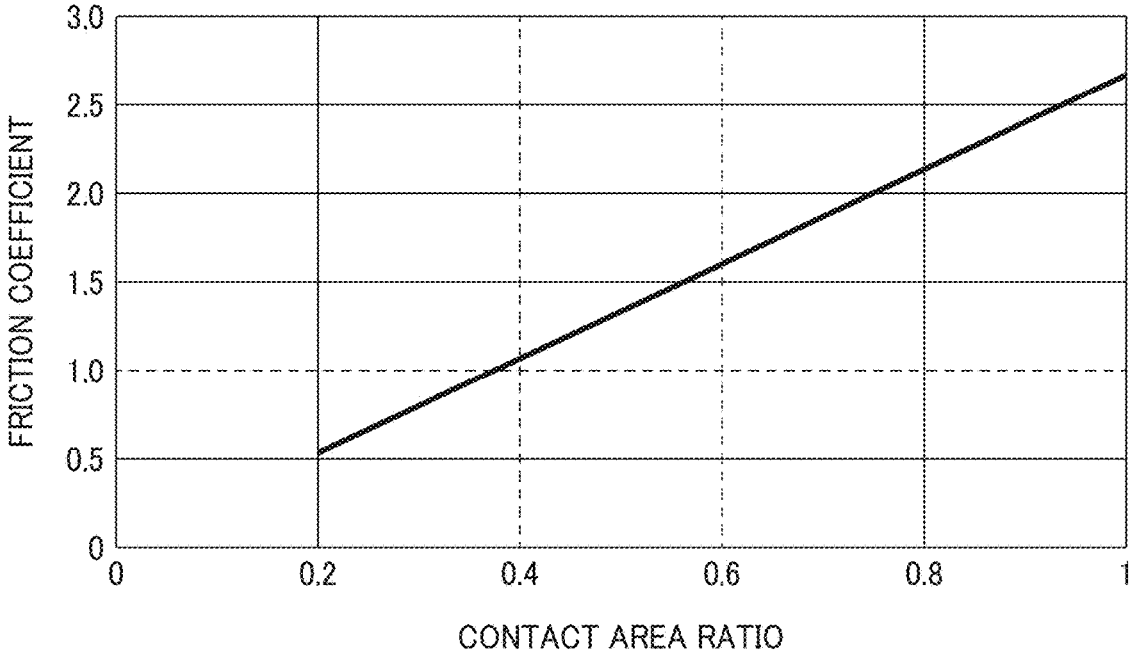
Figure 11:
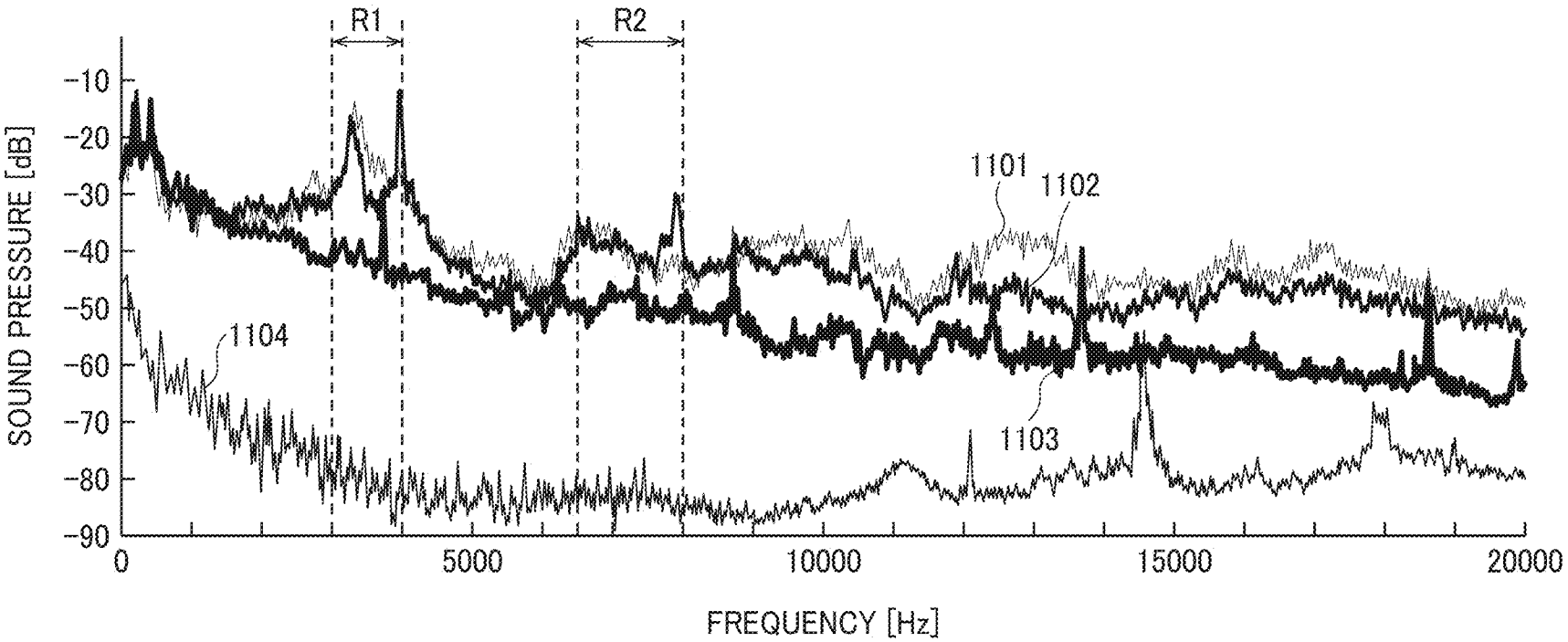
FIG. 11 is a graph illustrating a relation between frequency and sound pressure.

FIGS. 10A, 10B, and 11 are graphs illustrating the contact area ratio P of the separation roller 113.

FIG. 10A is a graph illustrating a relation between a load factor applied to the medium fed by the feed roller 112 and the separation roller 113 and a slip factor between the feed roller 112 and the medium. In FIG. 10A, the horizontal axis represents the load factor applied to the medium fed by the feed roller 112 and the separation roller 113, and the vertical axis represents the slip factor between the feed roller 112 and the medium. A graph 1001 represents the slip ratio in the case where the contact area ratio P of the separation roller 113 is 0.37, and a graph 1002 represents the slip ratio in the case where the contact area ratio P of the separation roller 113 is 0.40.

The load factor n applied to the medium fed by the feed roller 112 and the separation roller 113 is calculated by the following Expression 9.

$$\eta = F/W \tag{9}$$

Here, W represents a force of pressing the separation roller 113 toward the feed roller 112 by the pressing member 119. F is a force applied to a fed medium in the direction opposite to the media conveyance direction A1 by the pressing force W.

The slip ratio R between the feed roller 112 and the medium is calculated by the following Expression 10.

$$R = \{(V_r - V_p)/V_r\} \times 100 \quad (10)$$

In Expression 10, $V_r$ represents the peripheral velocity of the feed roller 112 (the moving speed of the surface 112*a* of the feed roller 112). Vp is the moving speed of the surface of the medium.

When the slip ratio is 0%, the medium is fed without slipping with respect to the feed roller 112. When the slip ratio is 100%, the medium is stopped even though the feed roller 112 is rotating. The load factor n when the slip factor is 100%, that is, the load factor n when the medium is stopped, indicates the friction coefficient between the feed roller 112 and the medium, and the friction coefficient between the separation roller 113 and the medium. In other words, as illustrated in the graph 1001, the friction coefficient between the separation roller 113 and the medium is about 0.9 when the contact area ratio P of the separation roller 113 is 0.37. As illustrated in the graph 1002, the friction coefficient between the separation roller 113 and the medium is about 1.0 when the contact area ratio P of the separation roller 113 is 0.40.

A driving force from a motor (to be described later) is transmitted to the separation roller 113 via a torque limiter. The limit value of the torque limiter is set to such a value that the rotational force via the torque limiter is interrupted when there is one medium, and the rotational force via the torque limiter is transmitted when there are a plurality of media. Thus, when only one medium is conveyed, the separation roller 113 is not rotated by the driving force from the motor but is driven by the rotation of the feed roller 112. On the other hand, when a plurality of media are conveyed, the separation roller 113 rotates in the direction opposite to the media feeding direction or stops, and separates a medium contacting the feed roller 112 from the other media, thus preventing the occurrence of multiple feeding. When only one medium is conveyed, the separation roller 113 is driven by the rotation of the feed roller 112, which can prevent only a specific area of the separation roller 113 from continuing to face the feed roller 112 and being worn.

However, in order for the separation roller 113 to be driven by the rotation of the feed roller 112, the friction coefficient between the separation roller 113 and the medium needs to have a value of 1.0 or greater, and therefore the contact area ratio P of the separation roller 113 needs to be 0.40 or greater.

FIG. 10B is a graph illustrating the relationship between the contact area ratio P of the separation roller 113 and the friction coefficient between the separation roller 113 and the medium. In FIG. 10B, the horizontal axis represents the contact area ratio P of the separation roller 113, and the vertical axis represents the friction coefficient between the separation roller 113 and the medium. As illustrated in FIG. 10B, a proportional relation is established between the contact area ratio P and the friction coefficient. As described above, when the friction coefficient is less than 1.0, the separation roller 113 is not driven by the rotation of the feed roller 112 when only one medium is conveyed. Therefore, the contact area ratio P of the separation roller 113 is preferably 0.40 or greater such that the friction coefficient is 1.0 or greater. When the contact area ratio P of the separation roller 113 is set to 0.40 or greater, the media feeding apparatus 100 can prevent only a specific region of the separation roller 113 from being worn during media feeding.

FIG. 11 is a graph illustrating a relation between frequency and sound pressure of the noise generated around the separation roller 113. In FIG. 11, the horizontal axis represents frequency, and the vertical axis represents sound pressure. A graph 1101 illustrates a graph during media feeding by the separation roller in which the contact area ratio S is 0.70. A graph 1102 illustrates a graph during media feeding by the separation roller in which the contact area ratio S is 0.65. A graph 1103 illustrates a graph during media feeding by the separation roller in which the contact area ratio S is 0.60. A graph 1104 illustrates a graph when no medium is fed.

As illustrated in the graphs 1101 and 1102, in the separation roller having the contact area ratio S of 0.70 or 0.65, a large abnormal noise (squeaking noise) occurs in a frequency band R1 of 3 kHz to 4 kHz and a frequency band R2 of 6.5 kHz to 8 kHz, which is a harmonic of the frequency band R1, during the media feeding. On the other hand, as illustrated in the graph 1103, in the case of the separation roller having the contact area ratio S of 0.60, no large abnormal noise (squeaking) occurs in the frequency bands R1 and R2 during the media feeding. In other words, when the contact area ratio P of the separation roller 113 is set to be 0.60 or less, the media feeding apparatus 100 can reduce the occurrence of squeaking noise.

Therefore, the opening portion 113*d* of the separation roller 113 is preferably set such that the contact area ratio P of the separation roller 113 is 0.4 or greater and 0.6 or less. Thus, the media feeding apparatus 100 can reduce the occurrence of squeaking while reducing the wear of the separation roller 113 during the media feeding.

In the flat portions 113*c* of the separation roller 113, two or more opening portions 113*d* are preferably disposed in any line along the circumferential direction in the nip region N. Accordingly, the media feeding apparatus 100 can reduce the occurrence of squeaking noise more favorably.

Further, as in the case of the surface 112*a* of the feed roller 112, the contact area ratio P on the surface 113*a* of the separation roller 113 is preferably set to be 0.5 or greater. When the contact area ratio S of the separation roller 113 is set to be 0.5 or greater, the media feeding apparatus 100 can reduce the frequency of occurrence of slip of the medium when a medium is separated.

The opening portions 113*d* may be omitted from the surface 113*a* of the separation roller 113. In this case, the contact area ratio P of the separation roller 113 is calculated by the following Expression 11.

$$\text{Contact area ratio } P = \{(\text{surface area of surface } 113a \text{ of seperation roller } 113 \text{ in nip region } N - \text{area of grooves } 113b \text{ of seperation roller } 113 \text{ in nip region } N)\}/(\text{surface area of surface } 113a \text{ of seperation roller } 113 \text{ in nip region } N) \quad (11)$$

The contact area ratio P of the separation roller 113 is defined as the following Expression 12 from Expression 11. The pitch L3 of the grooves 113*b* of the separation roller 113 is defined as the following Expression 13 from Expression 12.

$$\text{Contact area ratio } P = \{(\text{pitch } L3 \text{ of grooves } 113b \text{ of seperation roller } 113 - \text{width } L4 \text{ of groove } 113b \text{ of seperation roller } 113)\}/(\text{pitch } L3 \text{ of grooves } 113b \text{ of seperation roller } 113) \quad (12)$$

$$\text{Pitch } L3 \text{ of grooves } 113b \text{ of seperation roller } 113 = (\text{width } L4 \text{ of groove } 113b \text{ of seperation roller } 113)/(1-\text{contact area ratio } P) \quad (13)$$

Since the minimum value of the width L4 of the groove 113*b* of the separation roller 113 is 0.5 mm and the minimum value of the contact area ratio P is 0.5, the minimum value of the pitch L3 of the grooves 113*b* of the separation roller 113 is 1.0 mm. Therefore, the pitch L3 of the grooves 113*b* of the separation roller 113 is 1.0 mm or greater.

Thus, the separation roller 113 can continue to separate a medium favorably for a long period of time from the initial state while efficiently accommodating the foreign matter attached to the fed medium in the grooves 113*b*.

Further, as in the case with the groove 112*b* of the feed roller 112, the width L4 of the groove 113*b* of the separation roller 113 may be set to 2.0 mm or less. As described above, the fiber length of 95% or more of hardwood pulps used as paper sheets is 2.0 mm or less, and the fiber length of 50% or more of softwood pulps used as paper sheets is 2.0 mm or less. Accordingly, when the width L4 of the groove 113*b* of the separation roller 113 is set to 2.0 mm, the media feeding apparatus 100 can accommodate most of the fibers of the hardwood pulps and the softwood pulps in the grooves 112*b* of the feed roller 112. Further, the pitch L3 of the grooves 113*b* of the separation roller 113 may be set to 4.0 mm or less, as in the case of the grooves 112*b* of the feed roller 112.

Figure 12:
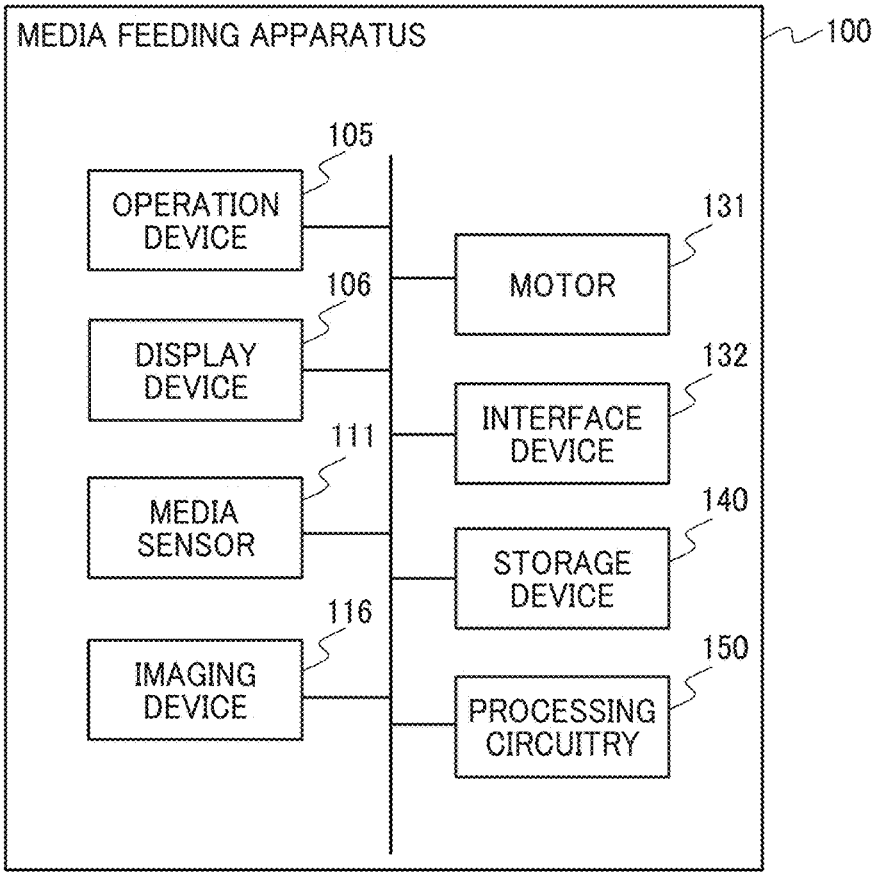
FIG. 12 is a block diagram illustrating a schematic configuration of the media feeding apparatus.

FIG. 12 is a block diagram illustrating a schematic configuration of the media feeding apparatus 100.

The media feeding apparatus 100 further includes, for example, a motor 131, an interface device 132, a storage device 140, and processing circuitry 150, in addition to the above-described configuration.

The motor 131 has one or a plurality of motors, and rotates the feed roller 112, the separation roller 113, the first conveyance roller 114, and/or the second conveyance roller 117 to convey a medium in accordance with a control signal from the processing circuitry 150. The first counter roller 115 and/or the second counter roller 118 may be rotated by the driving force of the motor 131, instead of being rotated by the rotation of the first conveyance roller 114 or the second conveyance roller 117.

The interface device 132 includes an interface circuitry compatible with a serial bus, such as a Universal Serial Bus (USB), and is electrically connected to an information processing apparatus (e.g., a personal computer or a portable information terminal) to transmit and receive input images and various types of information. Instead of the interface device 132, a communication unit may be used, which includes an antenna that transmits and receives wireless signals and a wireless communication interface device that transmits and receives signals through a wireless communication line according to a predetermined communication protocol. The predetermined communication protocol is, for example, a wireless local area network (LAN). The communication unit may include a wired communication interface device that transmits and receives signals through a wired communication line according to a communication protocol such as a wired LAN.

The storage device 140 includes a memory device such as a random-access memory (RAM) or a read-only memory (ROM), a fixed disk device such as a hard disk, or a portable storage device such as a flexible disk or an optical disk. The storage device 140 stores computer programs, databases, tables, and other data used for various types of processing of the media feeding apparatus 100. The computer program may be installed from a portable computer-readable recording medium to the storage device 140 by using a known setup program, etc.

The portable recording medium is, for example, a compact disc read-only memory (CD-ROM) and a digital versatile disc read-only memory (DVD-ROM).

The processing circuitry 150 operates based on a program previously stored in the storage device 140. The processing circuitry is, for example, a central processing unit (CPU). As the processing circuitry 150, for example, a digital signal processor (DSP), a large scale integration (LSI), an application-specific integrated circuit (ASIC), or a field-programmable gate array (FPGA) may be used.

The processing circuitry 150 is connected to the operation device 105, the display device 106, the media sensor 111, the imaging device 116, the motor 131, the interface device 132, the storage device 140, etc., to control each of these devices. The processing circuitry 150 controls, for example, the driving of the motor 131 and the image capturing by the imaging device 116, according to the media signals received from the media sensor 111. The processing circuitry 150 acquires an input image from the imaging device 116 and transmits the input image to the information processing apparatus via the interface device 132.

Figure 13:
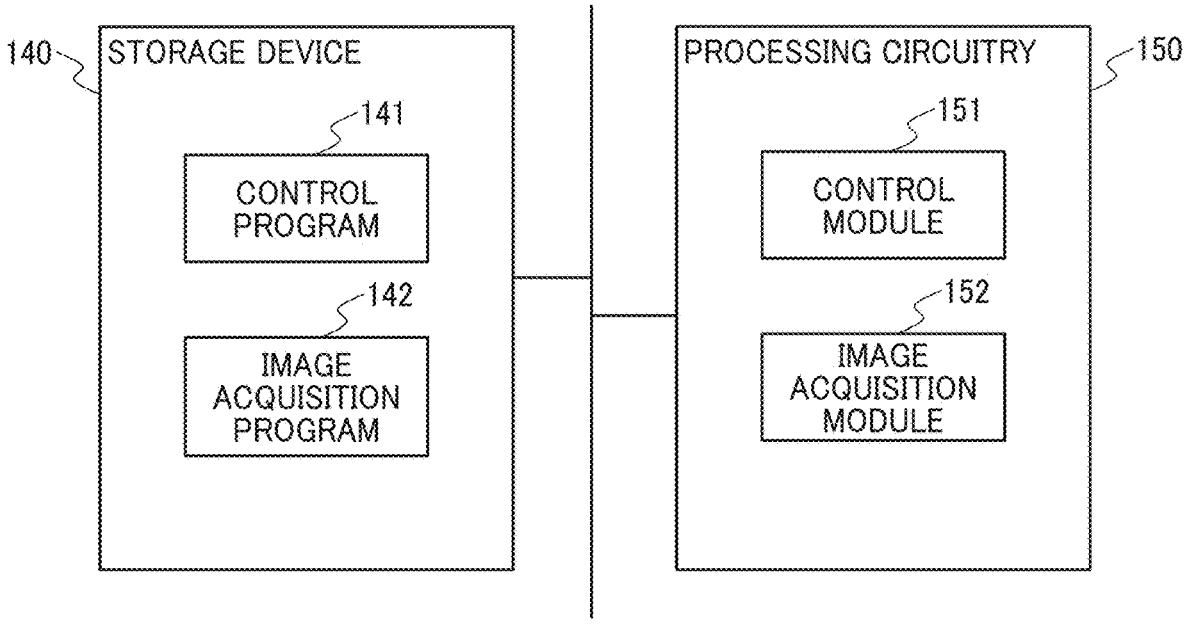
FIG. 13 is a diagram illustrating a schematic configuration of a storage device and processing circuitry.

FIG. 13 illustrates schematic configurations of the storage device 140 and the processing circuitry 150.

As illustrated in FIG. 13, the storage device 140 stores a control program 141, an image acquisition program 142, etc. These programs are functional modules implemented by software operating on a processor. The processing circuitry 150 reads each program stored in the storage device 140 and operates in accordance with each read program. Thus, the processing circuitry 150 functions as a control module 151 and an image acquisition module 152.

Figure 14:
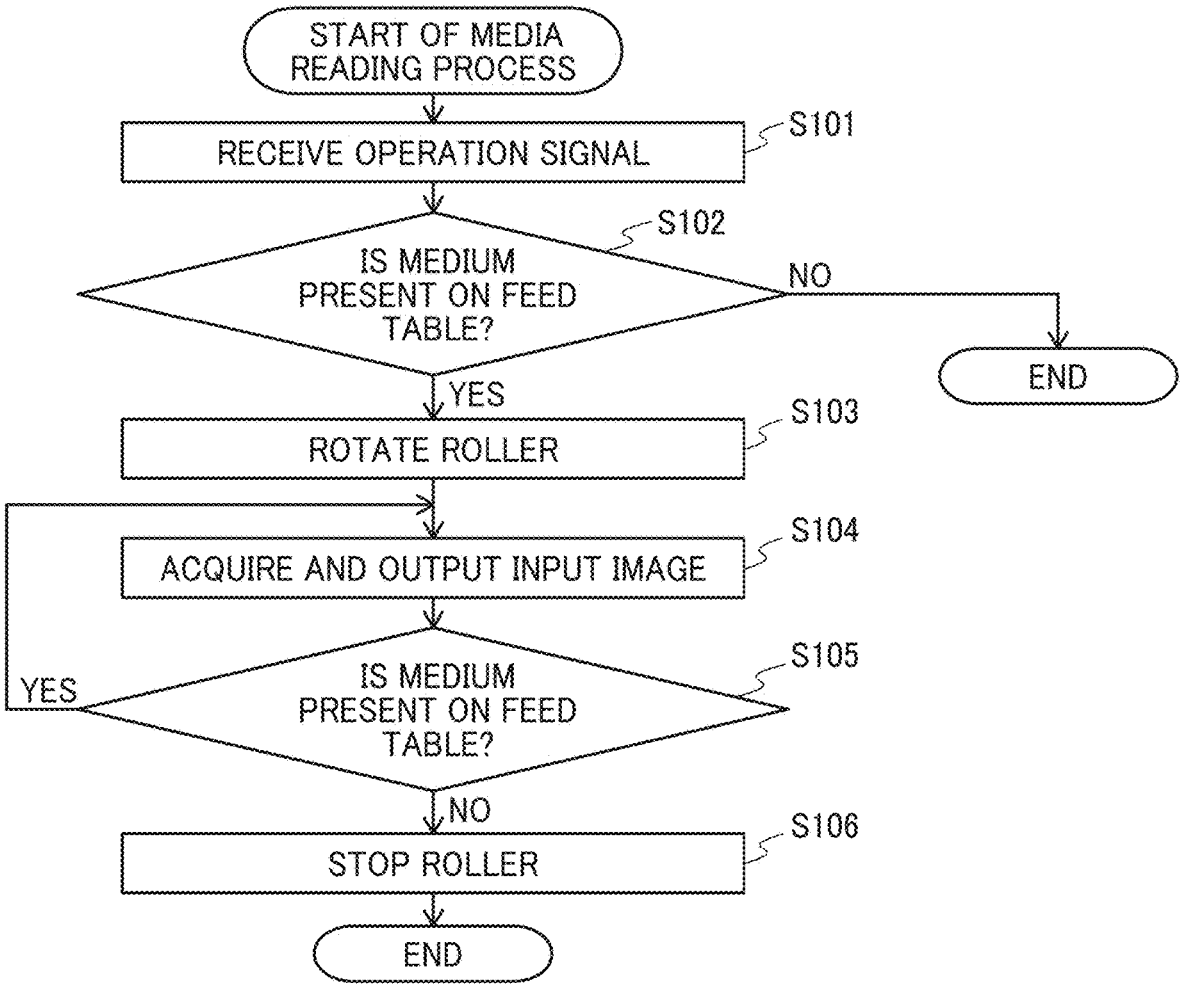
FIG. 14 is a flowchart illustrating an example of an operation of a media reading process.

FIG. 14 is a flowchart illustrating an example of an operation of a media reading process of the media feeding apparatus 100.

An example of the operation of the media reading process of the media feeding apparatus 100 will be described below with reference to the flowchart illustrated in FIG. 14. The flow of the operation described below is performed primarily by the processing circuitry 150 in cooperation with each element of the media feeding apparatus 100 based on a program previously stored in the storage device 140.

First, the control module 151 waits until an instruction to read a medium is input by the user using the operation device 105 or an information processing apparatus and an operation signal indicating the reading of the medium is received from the operation device 105 or the interface device 132 (step S101).

Subsequently, the control module 151 acquires a media signal from the media sensor 111 and, based on the acquired media signal, determines whether a medium is placed on the feed table 103 (step S102). When no medium is placed on the feed table 103, the control module 151 terminates the series of steps.

On the other hand, when a medium is placed on the feed table 103, the control module 151 drives the motor 131 to rotate the feed roller 112, the separation roller 113, the first conveyance roller 114, and/or the second conveyance roller 117 (step S103). Thus, the control module 151 causes the rollers to feed and convey the medium.

Subsequently, the control module 151 causes the imaging device 116 to image the medium, acquires an input image from the imaging device 116, and transmits the acquired input image to the information processing apparatus via the interface device 132 to output the input image (step S104).

Subsequently, the control module 151 determines whether a medium remains on the feed table 103 based on the media signal received from the media sensor 111 (step S105). When a medium remains on the feed table 103, the control module 151 returns the process to step S104 and repeats the processes of steps S104 and S105.

On the other hand, when no medium remains on the feed table 103, the control module 151 controls the motor 131 to stop the feed roller 112, the separation roller 113, the first conveyance roller 114, and/or the second conveyance roller 117 (step S106). Then, the control module 151 terminates the series of steps.

As described above, in the media feeding apparatus 100, the grooves 112*b* are formed in the feed roller 112 such that foreign matter can be favorably accommodated while the occurrence of slip of the medium is reduced. As a result, the media feeding apparatus 100 can feed the medium more favorably.

Further, in the media feeding apparatus 100, the separation roller 113 is formed with the grooves 113*b* and the opening portions 113*d* such that the occurrence of squeaking noise can be reduced while the occurrence of wear of the separation roller 113 is reduced. Accordingly, the media feeding apparatus 100 can reduce the frequency of replacement of parts and enhance the usability. As a result, the convenience of the user can be enhanced.

In the media feeding apparatus 100, in particular, the opening portions 113*d* (concave portions) are disposed on the flat portions 113*c*, instead of projections disposed on the surface 113*a* of the separation roller 113, to reduce the occurrence of squeaking noise. Even when the separation roller 113 is worn, it takes a long time until the entire flat portions 113*c* are worn and the opening portions 113*d* are eliminated. Thus, the media feeding apparatus 100 can reduce the occurrence of squeaking noise for a long period of time.

Figure 15:
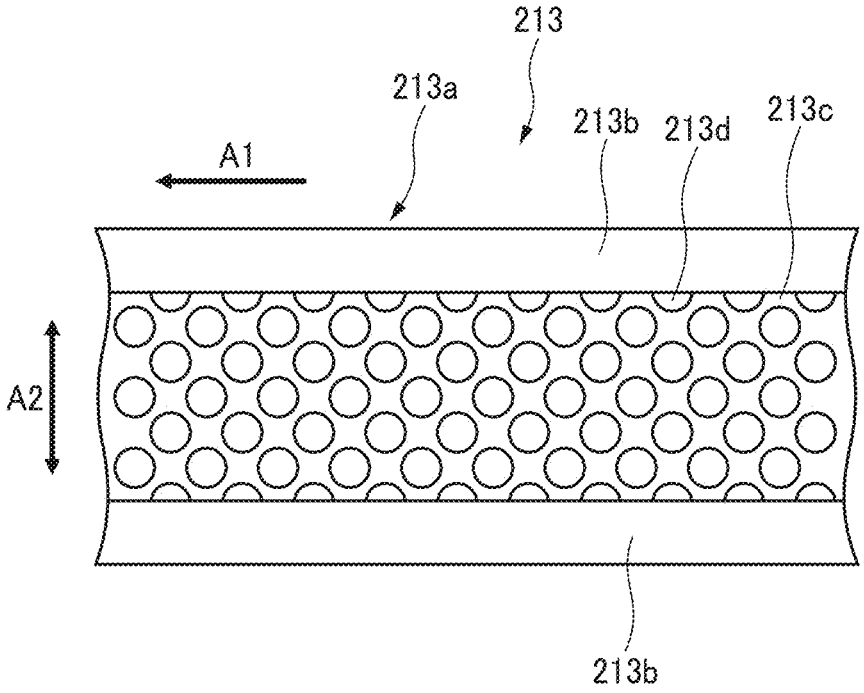
FIG. 15 is a schematic view of another separation roller.

FIG. 15 is a schematic diagram illustrating a surface 213*a* of a separation roller 213 in a media feeding apparatus according to another embodiment.

The separation roller 213 illustrated in FIG. 15 is used in place of the separation roller 113 of the media feeding apparatus 100. The separation roller 213 has a similar structure to the separation roller 113. However, on the surface 213*a* of the separation roller 213, a plurality of opening portions 213*d* are formed in a plurality of flat portions 213*c* arranged between a plurality of grooves 213*b*. The plurality of opening portions 213*d* are arranged in a staggered manner. Accordingly, in the media feeding apparatus, the opening portions 213*d* can be efficiently arranged at a high density on the surface 213*a* of the separation roller 213, thus further reducing the occurrence of squeaking noise.

Figure 16:
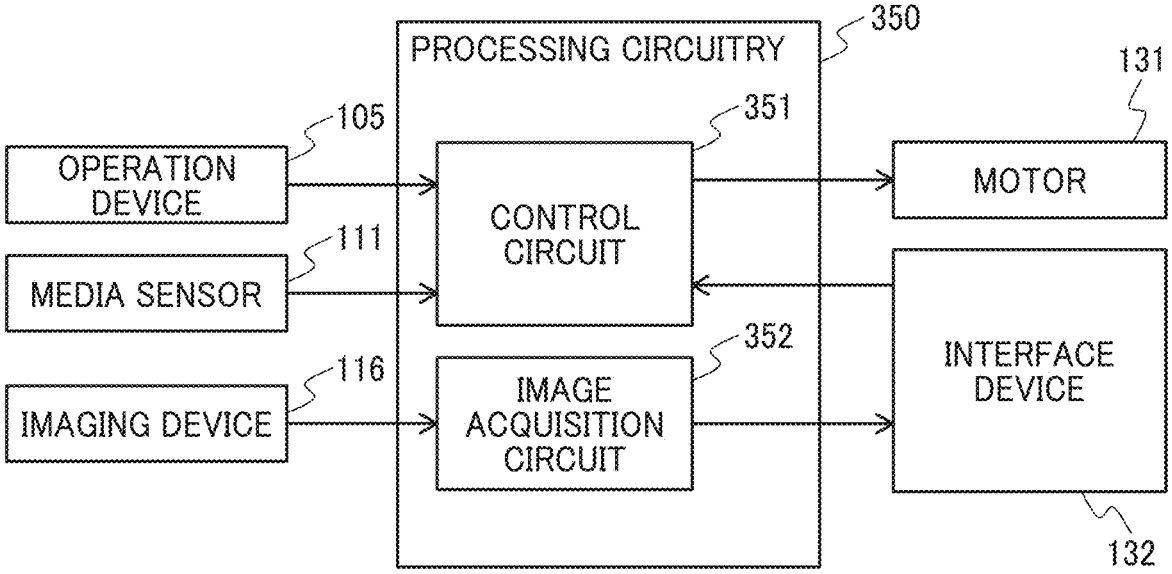
FIG. 16 is a diagram illustrating a schematic configuration of other processing circuitry.

As described above, the media feeding apparatus can feed a medium more favorably even when the plurality of opening portions 213*d* are arranged in a staggered manner. FIG. 16 is a diagram illustrating a schematic configuration of processing circuitry 350 in a media feeding apparatus according to still another embodiment. The processing circuitry 350 is used in place of the processing circuitry 150 of the media feeding apparatus 100, and executes a media reading process and other processes in place of the processing circuitry 150. The processing circuitry 350 includes a control circuit 351 and an image acquisition circuit 352. Each of these parts may include an independent integrated circuit, microprocessor, firmware, etc.

The control circuit 351 is an example of the control unit and has a function similar to that of the control module 151. The control circuit 351 receives operation signals from an operation device 105 or an interface device 132 and medium signals from a media sensor 111. The control circuit 351 controls a motor 131 based on each piece of information received.

The image acquisition circuit 352 is an example of an image acquisition unit and has a function similar to that of the image acquisition module 152. The image acquisition circuit 352 acquires an input image from an imaging device 116 and outputs the input image to the interface device 132.

As described above, the media feeding apparatus can feed a medium more favorably even when the processing circuitry 350 is used.

With respect to the above-described embodiments, the following additional descriptions are further disclosed.

First Aspect

A media feeding apparatus includes: a feed roller to feed a medium; a separation roller formed of a resin and disposed to face the feed roller; and a pressing portion to press one of the feed roller and the separation roller against the other of the feed roller and the separation roller to form a nip region at a position where the feed roller and the separation roller contact each other. A plurality of grooves arranged parallel to a feeding direction of the medium and a plurality of flat portions arranged between the plurality of grooves are formed on a surface of the separation roller. A plurality of opening portions are formed in each of the plurality of flat portions. The plurality of opening portions are set to have a contact area ratio P of 0.4 or greater and 0.6 or less. The contact area ratio P is a value obtained by {(a surface area of the separation roller in the nip region)−(an area of grooves of the separation roller in the nip region−a total area of opening portions of the separation roller in the nip region)}/(the surface area of the separation roller in the nip region).

Second Aspect

In the media feeding apparatus according to the first aspect, the plurality of opening portions are arranged in a staggered manner.

Third Aspect

In the media feeding apparatus according to the first or second aspect, each of the plurality of opening portions has a diameter of 0.10 mm or greater and 0.35 mm or less.

Fourth Aspect

In the media feeding apparatus according to any one of the first to third aspects, each of the plurality of opening portions has a depth of 0.2 mm or greater and 1.0 mm or less.

Fifth Aspect

In the media feeding apparatus according to any one of the first to fourth aspects, a plurality of grooves arranged perpendicular to the feeding direction of the medium are formed on a surface of the feed roller.

Sixth Aspect

In the media feeding apparatus according to the fifth aspect, a pitch of the plurality of grooves of the feed roller is set such that at least one groove is always present in the nip region during feeding of the medium. Each of the plurality of grooves of the feed roller has a width of 0.5 mm or greater. A contact area ratio S is 0.5 or greater, and the contact area ratio S is a value obtained by {(a surface area of the feed roller in the nip region–an area of the at least one groove of the feed roller in the nip region)}/(the surface area of the feed roller in the nip region).

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Any one of the above-described operations may be performed in various other ways, for example, in an order different from the one described above.

The invention claimed is:

1. A media feeding apparatus, comprising:

a feed roller to feed a medium;

a separation roller facing the feed roller; and a pressing portion to press one of the feed roller and the separation roller against the other of the feed roller and the separation roller to form a nip region at a position where the feed roller and the separation roller contact each other, wherein a surface of the feed roller has a plurality of grooves extending in a width direction of the feed roller, the plurality of grooves of the feed roller are arranged with a pitch such that at least one groove is always present in the nip region during feeding of the medium, a width of each of the plurality of grooves of the feed roller is 0.5 mm or greater and is set such that a contact area ratio is 0.5 or greater, the contact area ratio being a value obtained by {(a surface area of the feed roller in the nip region–an area of the at least one groove of the feed roller in the nip region)}/(the surface area of the feed roller in the nip region), a surface of the separation roller has a plurality of grooves extending in a circumferential direction of the separation roller, a width of each of the plurality of grooves of the separation roller is 0.5 mm or greater and is set such that another contact area ratio is 0.5 or greater, and said another contact area ratio is a value obtained by {(a surface area of the separation roller in the nip region—an area of grooves of the separation roller in the nip region)}/(the surface area of the separation roller in the nip region).

2. The media feeding apparatus according to claim 1, wherein the width of each of the plurality of grooves of the feed roller is set such that the contact area ratio is 0.9 or less.

3. The media feeding apparatus according to claim 1, wherein the separation roller is formed of a resin.

4. The media feeding apparatus according to claim 1, wherein the width of each of the plurality of grooves of the feed roller is 2.0 mm or less, and the plurality of grooves of the feed roller are arranged with a pitch in a range of 1.0 mm or greater and 4.0 mm or less.

* * * * *